United States Patent [19]

Ben-Lea

[11] 4,127,253

[45] Nov. 28, 1978

[54] HOLDER FOR BOOKS, MUSIC SHEETS, OR OTHER SHEET-CONTAINING ARTICLES

[76] Inventor: Yehuda Ben-Lea, 10 Nachmani St., Tel Aviv, Israel

[21] Appl. No.: 823,457

[22] Filed: Aug. 10, 1977

[51] Int. Cl.[2] ..... A47B 97/04

[52] U.S. Cl. ..... 248/453

[58] Field of Search ..... 248/451, 452, 453, 455, 248/460, 465; 240/2 R

[56] References Cited

U.S. PATENT DOCUMENTS

| | | | |
|---|---|---|---|
| 247,324 | 9/1881 | Ernsberger | 248/453 |
| 353,582 | 11/1886 | Palmer | 248/453 |
| 1,432,620 | 10/1922 | Radlein et al. | 248/452 |
| 3,952,989 | 4/1976 | Hatcher | 248/460 X |
| 4,022,418 | 5/1977 | Kellner | 248/460 |

FOREIGN PATENT DOCUMENTS

| | | | |
|---|---|---|---|
| 2,291,550 | 6/1976 | France | 248/452 |
| 1,273,115 | 5/1972 | United Kingdom | 248/460 |

*Primary Examiner*—William H. Schultz
*Attorney, Agent, or Firm*—Benjamin J. Barish

[57] ABSTRACT

A holder for books, music sheets, or other sheet-containing articles, comprises a stand having a back rest, legs for supporting the back rest in an inclined position, a front lower edge, and a coil spring at each of the two opposite ends of the ledge, the loops of the coil springs being substantially parallel to the plane of the back rest for releasably engaging the lower ends of the sheets supported by the stand.

6 Claims, 3 Drawing Figures

HOLDER FOR BOOKS, MUSIC SHEETS, OR OTHER SHEET-CONTAINING ARTICLES

BACKGROUND OF THE INVENTION

The present invention relates to a holder for books, music sheets, or other sheet-containing articles.

Holders for the above type articles usually include an arrangement for retaining the article in open condition as each sheet is turned. However, the arrangements commonly used are generally not entirely satisfactory from the standpoints of appearance, simplicity of construction, cost, and/or effectiveness in retaining the turned sheets.

An object of the present invention is to provide a holder having advantages in the above respects. cl

BRIEF SUMMARY OF THE INVENTION

According to the present invention, there is provided a holder for books, music sheets, or other sheet-containing articles, comprising a stand having a back rest, a front ledge at the lower end of the back rest and projecting forwardly thereof for supporting the article, and a plurality of legs for supporting the back rest in an inclined position. The holder further includes a coil spring mounted at each of the two opposite ends of the front ledge with the loop of the coil spring substantially parallel to the plane of the back rest for releasably engaging the lower ends of the sheets of the article supported by the stand.

In the preferred embodiment of the invention described below, the front ledge is formed with a pair of spaced parallel slots at each end extending transversely of the ledge, each of the coil springs being received in each pair of the slots.

According to a further feature, the upper end of the stand includes a resilient clip for releasably engaging the upper ends of the sheets. Further features and advantages of the invention will be apparent from the description below.

BRIEF DESCRIPTION OF THE DRAWINGS

The invention is herein described, by way of example only, with reference to the accompanying drawings, wherein.

DESCRIPTION OF THE PREFERRED EMBODIMENT

Figure 1:
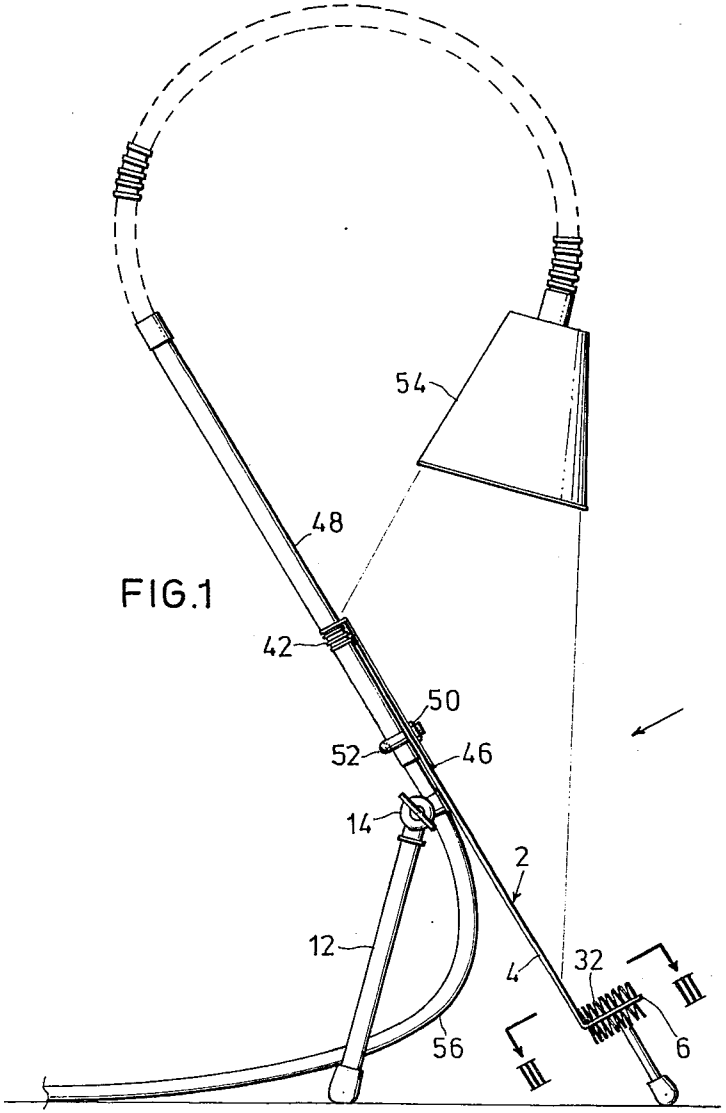
FIG. 1 is a side elevational view illustrating one form of holder constructed in accordance with the invention.

The holder illustrated in the drawings is particularly useful for holding books, music sheets, or other sheet-containing articles with each page being retained in position after turning during reading by the user.

Figure 2:
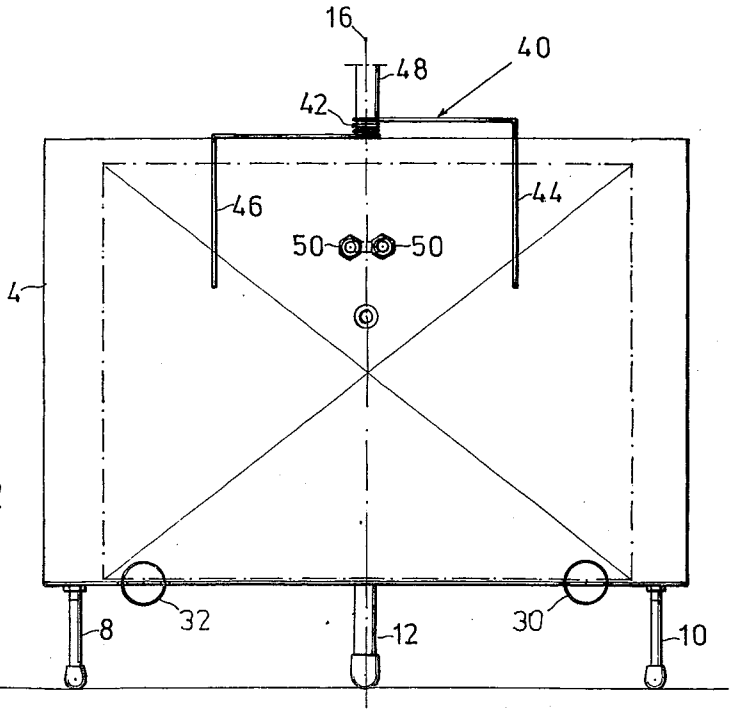
FIG. 2 is a front elevational view of the holder of FIG. 1.

The illustrated holder comprises a stand, generally designated 2, having a back rest 4 and a front ledge 6 at the lower end of the back rest and projecting forwardly and perpendicularly thereof for supporting the article (not shown) to be held by the holder. The stand further includes a pair of end legs 8, 10 secured to the opposite ends of ledge 6, and a centre leg 12 secured by a ball-joint 14 to the rear face of the back rest 4 along its central axis 16 (FIG. 2). The three legs 8, 10 and 12 are adapted to support the back rest 4 in an inclined position (See FIG. 1).

Figure 3:
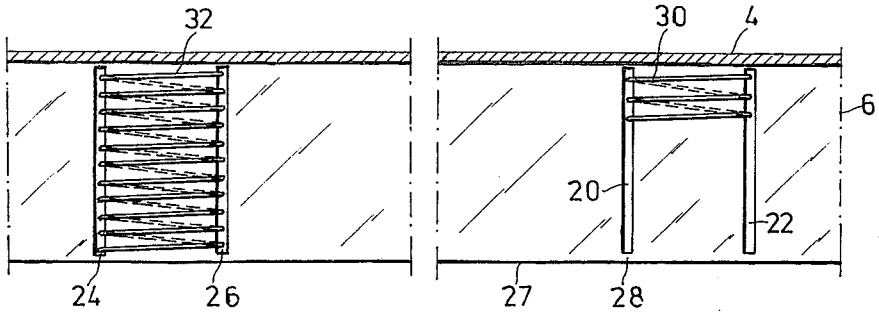
FIG. 3 is an enlarged view along section lines III—III of FIG. 1.

As shown particularly in FIG. 3, ledge 6 is formed with a first pair of spaced parallel slots 20, 22 at one end of the ledge, and with a second pair of spaced parallel slots 24, 26 at the opposite end of the ledge. Each of the slots terminates short of the free edge 27 of the ledge 6, as shown by web 28 with respect to slot 20. An open coil spring 30 is disposed within the two slots 20, 22; and a second open coil spring 32 is disposed within the two slots 24, 26.

It will be seen that the spacing between the slots in each pair is equal to the diameter of th coil spring received within the pair of slots, so that substantially the upper half of the coils extends above the ledge and the lower half extends below the ledge. The loops of the two coil springs 30, 32, respectively, are perpendicular to the plane of the ledge 6 and are parallel to the plane of the back rest 4. Accordingly, the upper sections of the coils in each coil spring are in position to be releasably engaged by the lower ends of the sheets of the book or other article supported on ledge 6, and to retain the book in its open condition as each page is turned.

The holder illustrated in the drawings also includes a resilient clip 40 at the upper end of the stand 2 for releasably engaging the upper ends of the sheets supported on the stand. Clip 40 includes an intermediate springy section 42 vertically mounted at the top of the back rest 4 along its centre axis 16, and a pair of down-turned end legs 44, 46 overlying the front page of the back rest at opposite sides of its centre axis 16. Legs 44, 46 of clip 40 thus engage the open end of the book supported on the holder and retain the book in its open condition.

The intermediate springy section 42 of clip 40 is freely mounted on a vertical standard 48 attached to the rear face of the back rest 4 by means of threaded fasteners 50 at the end of a bail-shape member 52 engaging the standard. Standard 48 carries a light fixture 54 for illuminating the books supported on stand 2, and is hollow to accommodate the electrical conductors 56 to the light fixture. While the invention has been described with respect to one preferred embodiment, it will be appreciated that many variations, modifications and other applications may be made.

What is claimed is:

1. A holder for books, music sheets, or other sheet-containing articles comprising: a stand having a back rest and a front ledge at the lower end of the back rest projecting forwardly thereof for supporting the article to be held thereby; a plurality of legs for supporting the back rest in an inclined position; and a coil spring mounted at each of the two opposite ends of the ledge with the loops thereof substantially parallel to the plane of the back rest for releasably engaging the lower ends of the sheets of the article supported by the stand, said front ledge being formed with a pair of spaced parallel slots at each end extending transversely of the ledge, each of said coil springs being received in each pair of said slots.

2. A holder according to claim 1, wherein the upper end of said stand includes a resilient clip for releasably engaging the upper ends of the sheets of the article supported by the stand.

3. A holder according to claim 2, wherein said resilient clip includes an intermediate springy section vertically mounted at the top of the back rest along the centre axis thereof and terminating in a pair of end legs overlying the back rest at opposite sides of its centre axis.

4. A holder according to claim 3, wherein said intermediate springy section of the resilient clip is supported on a vertical standard attached to the back rest and projecting upwardly thereof.

5. A holder according to claim 4, wherein said vertical standard carries a light fixture for illuminating the article supported by the stand.

6. A holder according to claim 1, wherein said plurality of legs comprises a pair of front legs secured to the bottom of the ledge at opposite ends thereof, and a centre leg pivotably secured to the rear face of the back rest.

* * * * *